US008312668B2

(12) United States Patent
Kincel

(10) Patent No.: US 8,312,668 B2
(45) Date of Patent: Nov. 20, 2012

(54) FIREARM MOUNTING MECHANISM

(75) Inventor: Eric Stephen Kincel, Tucson, AZ (US)

(73) Assignee: Abrams Airborne Inc, Tucson, AZ (US)

( * ) Notice: Subject to any disclaimer, the term of this patent is extended or adjusted under 35 U.S.C. 154(b) by 175 days.

(21) Appl. No.: 12/313,656

(22) Filed: Nov. 20, 2008

(65) Prior Publication Data

US 2010/0122485 A1 May 20, 2010

(51) Int. Cl.
*F41G 1/35* (2006.01)

(52) U.S. Cl. ..... 42/146; 42/114

(58) Field of Classification Search ..... 42/114, 42/115, 116, 117, 146, 124, 125, 127, 128
See application file for complete search history.

(56) References Cited

U.S. PATENT DOCUMENTS 1,770,451 A * 7/1930 Baker ..... 42/126
3,512,290 A 5/1970 Violette, Jr. et al.
4,026,055 A * 5/1977 Weast ..... 42/124
4,533,980 A 8/1985 Hayes
4,571,870 A 2/1986 Heideman et al.
5,027,542 A 7/1991 Simonetti
5,092,071 A 3/1992 Moore
5,107,612 A 4/1992 Bechtel
5,590,484 A 1/1997 Mooney et al.
5,685,105 A 11/1997 Teetzel
5,727,346 A 3/1998 Lazzarini et al.
5,881,486 A 3/1999 Bilgeri et al.
5,913,669 A 6/1999 Hansen et al.
6,023,875 A * 2/2000 Fell et al. ..... 42/146
6,318,015 B1 11/2001 Baumann et al.
6,378,237 B1 4/2002 Mattews et al.
6,622,416 B2 9/2003 Kim
6,655,069 B2 12/2003 Kim
6,851,214 B2 2/2005 Oz
7,882,654 B1 * 2/2011 Marcum et al. ..... 42/90

* cited by examiner

*Primary Examiner* — Stephen M Johnson
(74) *Attorney, Agent, or Firm* — Mark Ogram

(57) ABSTRACT

A combination and accessory for a firearm having a receiving mechanism such as a Picanny rail or similar mechanism. A bracket is used to secure an accessory to the firearm via the receiving mechanism. The bracket mechanism uses a holder configured to encircle a portion of the accessory and a securing bracket adapted to engage the receiving mechanism. A manually operated compression mechanism simultaneously engages the securing bracket with said receiving mechanism and the holder with said accessory for a firearm.

8 Claims, 6 Drawing Sheets

FIREARM MOUNTING MECHANISM

BACKGROUND OF THE INVENTION

Figure 1:
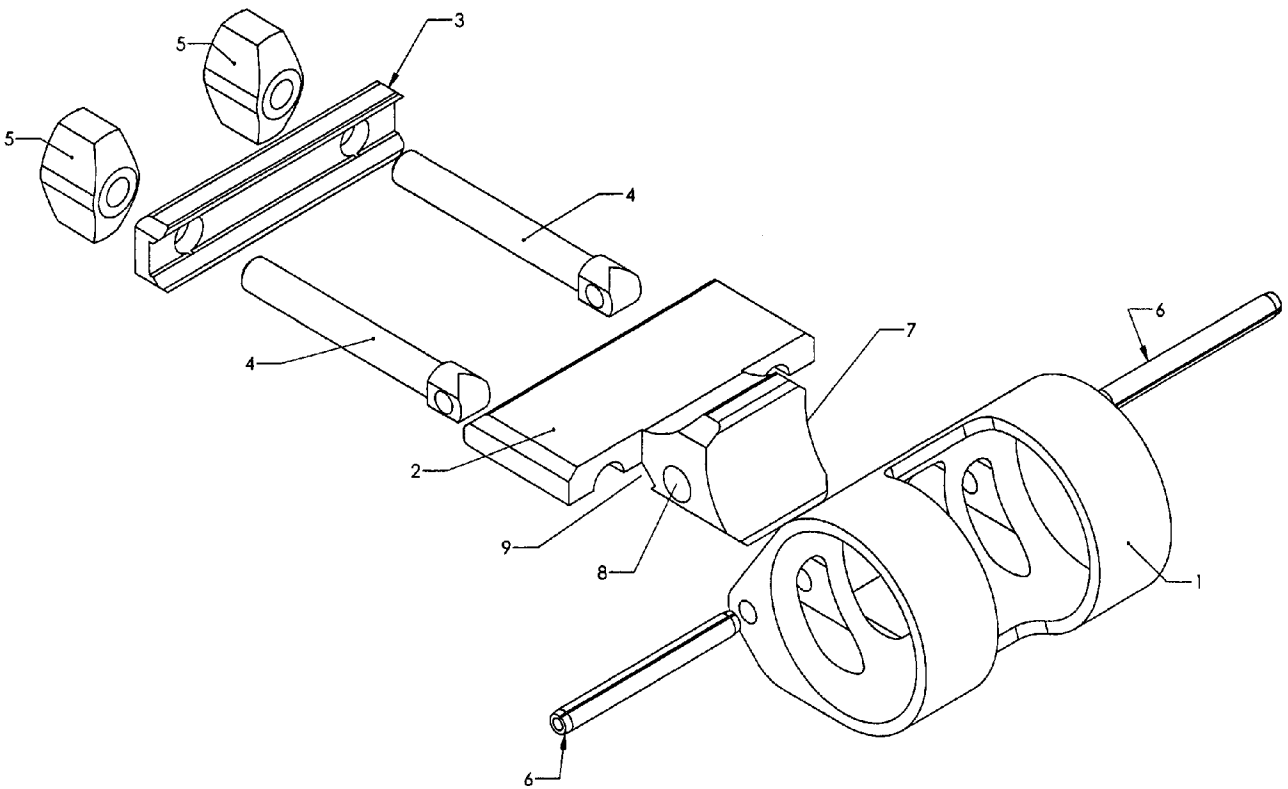

This invention relates generally to firearms and more particularly to a mounting mechanism used to secure accessory apparatus to the firearm.

In recent years, there has been an increase in practice and options of temporarily attaching various ancillary devices to firearms; these devices are varied in purpose and function, but among the most popular are flashlights, light collimator and laser devices for illumination, target identification/designation and aiming.

There is an increasing popularity in the firearms industry, to incorporate attachment rails for such devices; either into new firearm designs, or by way of add-on accessories. The locations and specifics of these attachment rails has become too numerous to mention, but is best typified by the attachment rails located around the forward handguard of current U.S. military and law enforcement rifles. Consequently, there are numerous types of mounts designed to attach to these rail systems.

These mounts, which most often are designed to hold a commercial flashlight, or similar tube shaped device, are often bulky, designed for only one specific accessory, and tedious to adjust, install and remove. The attachment to either the firearm or flashlight is semi-permanent, for example: while there may exist a provision to expedite removal of the mount from the firearm, complete removal of the mount from the flashlight requires the use of tools; under normal use, this leaves the mount attached to the flashlight, hindering its proper use.

It is clear that there is a need for a simple to use and versatile mechanism to secure a variety of apparatus to a firearm.

SUMMARY OF THE INVENTION

The invention is a combination and accessory for a firearm having a receiving mechanism such as a Picanny rail or similar mechanism. Those of ordinary skill in the art recognize a variety of rails which are used; the invention is not intended to be limited to any one of these receiving mechanisms.

A bracket is used to secure an accessory to the firearm via the receiving mechanism. Examples of such accessories include flashlights and sighting mechanisms; other such accessories are obvious to those of ordinary skill in the art.

The bracket mechanism uses a holder configured to encircle a portion of the accessory and a securing bracket adapted to engage the receiving mechanism. In use, the accessory is placed into the holder and then the securing bracket is positioned onto the receiving mechanism.

A manually operated compression mechanism simultaneously engages the securing bracket with said receiving mechanism and the holder with the accessory. In this way, the mechanism is secured in one step; in like fashion, the assembly is disassembled in a single step of removing the compression to both the holder and the securing bracket.

In this manner, the present invention provides an accessory mount for use on firearms or other equipment that provides a method of attachment (attachment rails), the mount consists of a frame having a through bore for receiving a flashlight or similar accessory, and a base and clamping surface for attaching the mount to the firearm attachment rail.

The far clamping surface moves to effect the clamping pressure on the mounting rail, this can be accomplished by various types of "quick disconnect" throw levers, cams, springs pressure, or by more traditional threaded fasteners.

As the device's clamping surface is tightened against the mounting rail, it forces the opposite side of the rail into a floating block that forms both the opposite clamping surface, and an internal surface that wedges against flashlight in the through bore.

This interference with the flashlight in the through bore, stops the travel of the floating block and allows the mount to adjust to the size of the flashlight body. This interference with the flashlight body is also what retains the flashlight in the housing.

By arresting the movement of the floating block, the damping surface incorporated into the block becomes fixed, thereby allowing the movable clamping surface to tighten and fix the housing to the mounting rail.

The invention, together with various embodiments thereof will be more fully explained by the attached drawings and the following description thereof.

DRAWINGS IN BRIEF

FIG. 1 is a disassembled view of the preferred embodiment of the invention.

FIGS. 2A, 2B, 2C, and 2D are different perspective views of the preferred embodiment of the invention.

Figure 3:
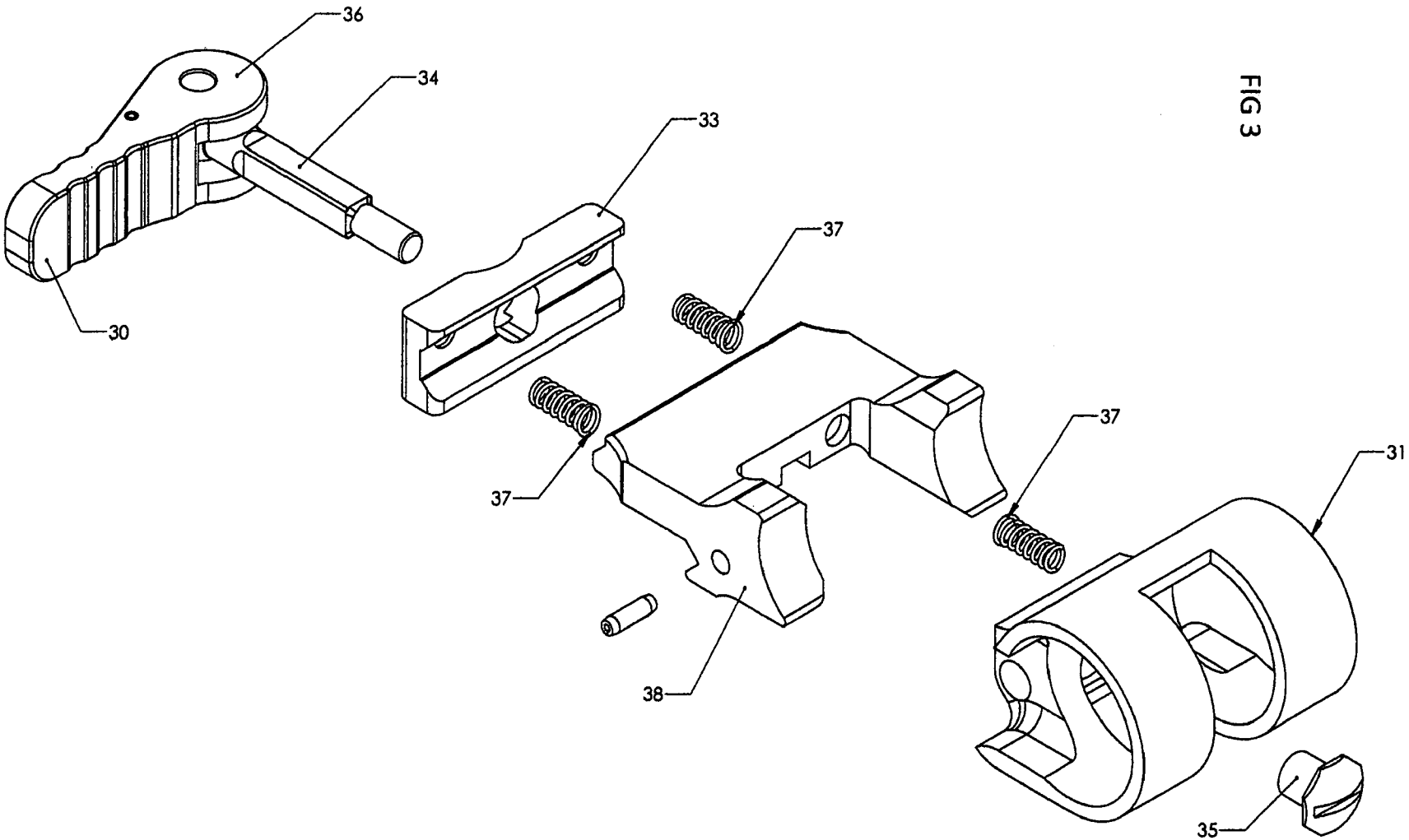
Figure 4B:
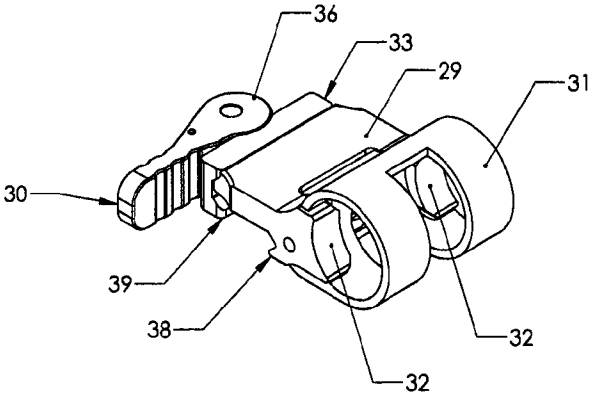
Figure 4D:
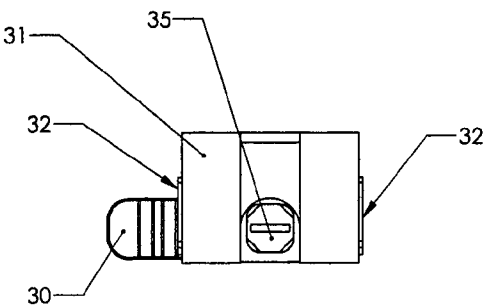
Figure 4A:
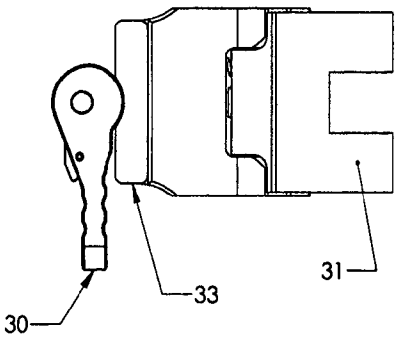
Figure 4C:
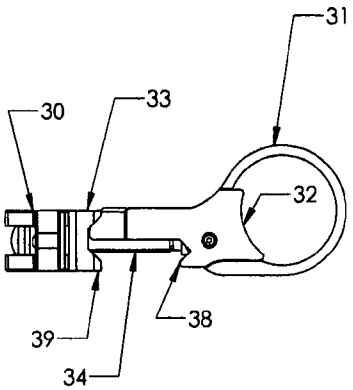

FIG. 3 is a disassembled view of an alternative embodiment of the invention.

FIGS. 4A, 4B, 4C, and 4D are different view of the alternative embodiment of the invention.

Figure 5C:
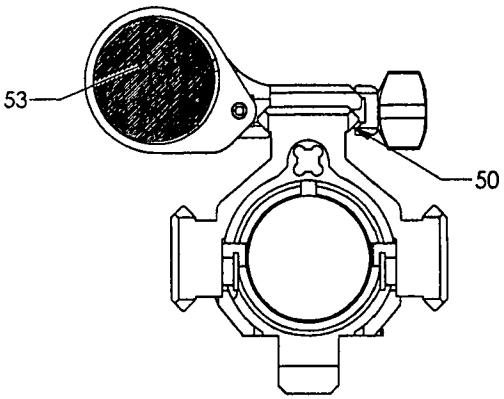
Figure 5B:
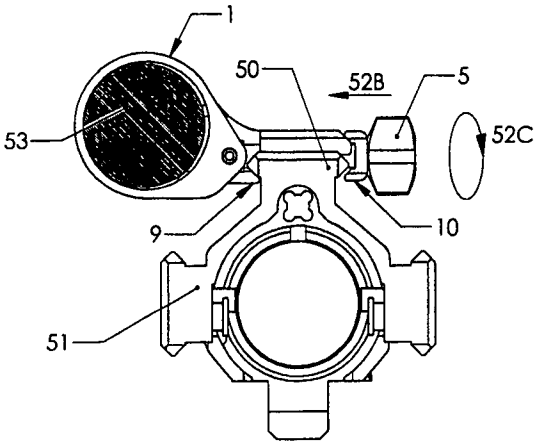
Figure 5A:
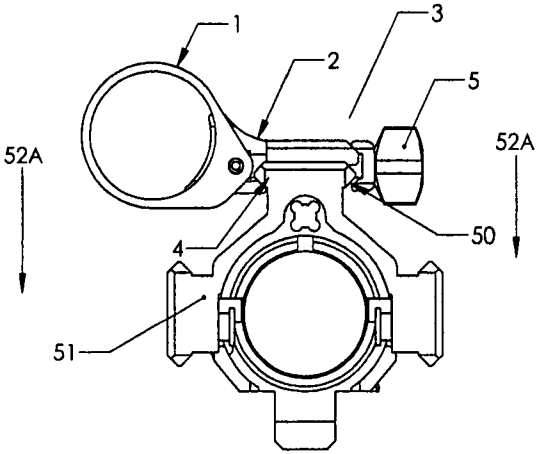

FIGS. 5A, 5B, and 5C illustrate the attachment of the invention to a mounting rail or similar receiving mechanism.

Figure 6:
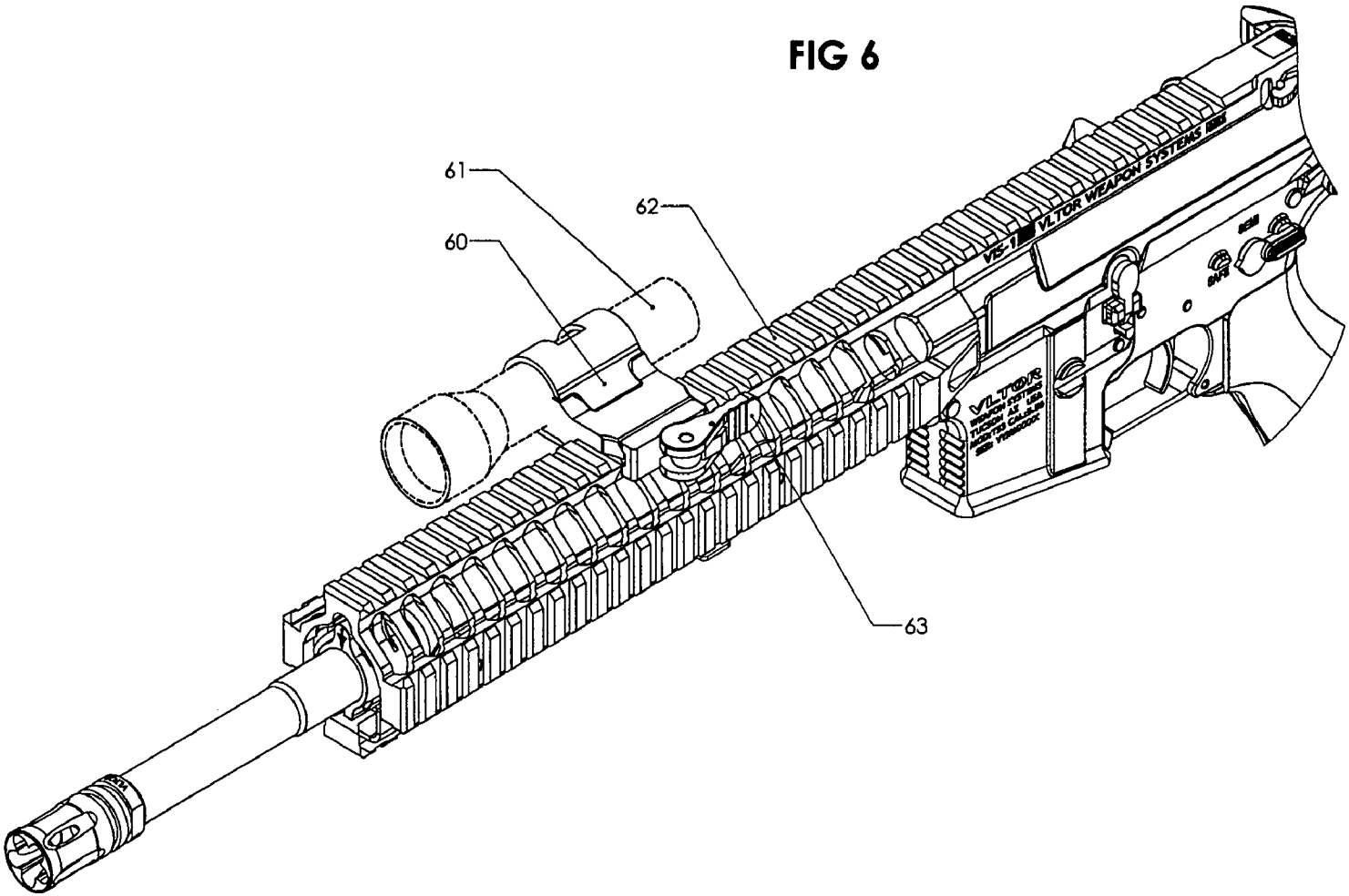

FIG. 6 is a perspective view of the alternative embodiment of the present invention mounted onto a firearm.

DRAWINGS IN DETAIL

FIG. 1 is a disassembled view of the preferred embodiment of the invention.

Holder 1 is configured to encircle an accessory for a firearm. This accessory, in this illustration, has a circular cross-section (such as a flashlight or a sighting laser). Secured to holder 1 are two guide members 4 which are secured to holder 1 via pins 6.

Pins 6 fit snugly into holder 1 and one end of guide members 4. Further, pins 6, in this embodiment of the invention, loosely engage tooth member 7 via hole 8. Hole 8 has a much greater diameter than the diameter of pin 6 and is used to maintain tooth 7 within holder 6; but, at the same time, pins 6 allow movement of tooth 7.

On tooth 7 is a clamping mechanism 9 which is configured to engage one side of the receiving mechanism on the firearm. Bracket 3 has two openings through which guides 4 extend. A bottom edge of bracket 3 is configured to engage a second side of the receiving mechanism.

A top side of bracket 3 engages push bar 2 of tooth 7.

Nuts 5 arc configured to be manually adjusted and are secured onto the ends of guide members 4. As nuts 5 are screwed onto guide members 4, Compression occurs between clamping mechanism 9 and 10: and simultaneously, tooth 7 is inserted into holder 1 to engage the accessory.

In this way, a single action by the operator both clamps the mechanism to the firearm and secures the accessory to the mechanism; thereby making it easy and fast to secure an accessory to a firearm.

FIGS. 2A, 2B, 2C, and 2D are different perspective views of the preferred embodiment of the invention.

Figure 2A:
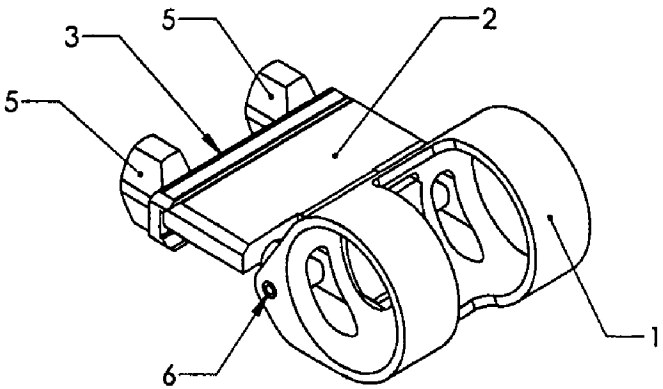

FIG. 2A is a perspective view of the assembled preferred embodiment first illustrated and described in FIG. 1.

Nuts 5 engage with bracket 3 which engages with push bar 2 which forces the tooth (not visible from this angle) into holder 1 to press against the accessory and sandwich the accessory firmly in place. Holder 1 is secured via pin 6 to the tooth mechanism 2.

Figure 2D:
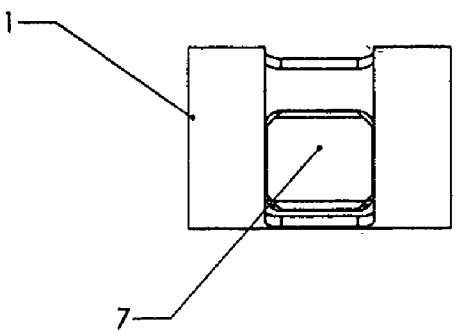
Figure 2B:
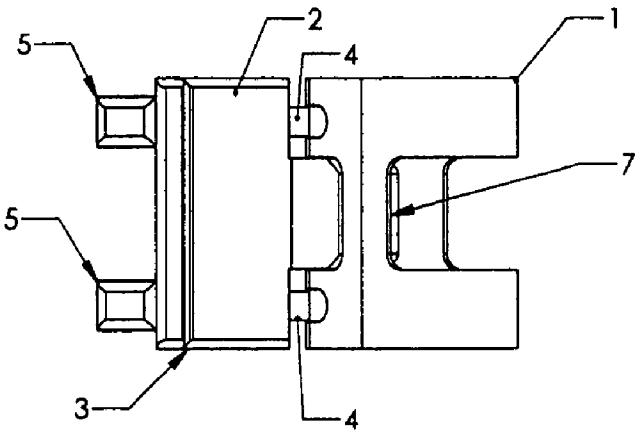
Figure 2C:
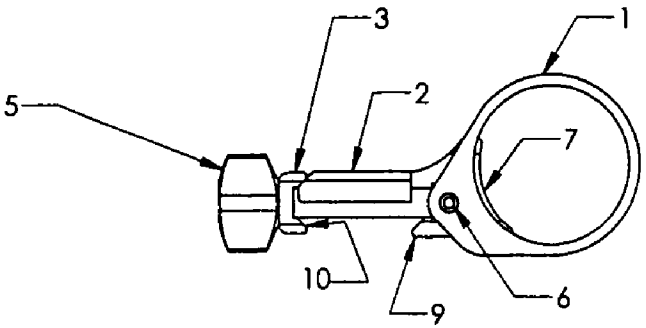

FIGS. 2B, 2C, and 2D, are differing views of the assembled preferred embodiment.

Guide pins 4 extend from holder 1 to nuts 5. Tooth 7 is positioned to extend into the center of holder 1 and engage the accessory (not shown). Push bar 2 is compressed by movement of nuts 5 via bracket 3 to both push tooth 7 into holder 1 and to compress the receiving mechanism (not shown) between clamping mechanisms 9 and 10.

FIG. 3 is a disassembled view of an alternative embodiment of the invention.

As with the embodiment of FIG. 1, holder 31 is configured to encircle an accessory for a firearm. While this illustration shows a circular cross section for an accessory, the invention is not so limited and may be of any shape.

Rotational handle 30 is secured to guide member 34 which extends through bracket 33 and is secured to holder 31. Guide member 34 is also configured to engage push bar 29, permitting push bar 29 to slide along a top surface of guide member 34. Push bar 29 is a component of tooth assembly 32 which, in this embodiment, has two teeth which selectively extend into bracket 31. An adjustment nut (not shown) allows for modification of the tension being applied by the rotational handle 30.

Guide member 34 is secured to holder 31 using screw 35.

Handle 30 is configured with an elliptical base 36 which is used to compress/decompress clamping mechanism 38 and 39 and insert/withdraw the teeth of tooth 32 into/out of holder 31. Springs 37 are used to bias the mechanism towards an uncompressed position.

During compression of the mechanism, a top side of bracket 33 engages push bar 29.

FIGS. 4A, 4B, 4C, and 4D are different view of the alternative embodiment of the invention.

Holder 31 is configured to encircle an accessory for a firearm, such as a laser sight. Rotational handle 30 is secured to guide member 34 which extends through bracket 33 and is secured to holder 31 using nut 35. Push bar 29 is pressed at one side by bracket 33 during the compression motion. When push bar 29 is pressed, tooth mechanism extends into bracket 31 to engage with the accessory contained therein.

Handle 30 is configured with an elliptical base 36 which is used to compress/decompress clamping mechanism 38 and 39 and insert/withdraw the teeth of tooth 32 into/out of holder 31.

FIGS. 5A, 5B, and 5C illustrate the attachment of the invention to a mounting rail or similar receiving mechanism.

The mechanism first shown in FIGS. 1, 2A, 2B, 2C, and 2D is positioned over a receiving mechanism 50 on a firearm 51 and then lowered into position as indicated by arrows 52A.

Accessory 53 is placed within holder 51, as shown in FIG. 5B, and nut 5 is tightened forcing compression, as indicated by arrow 52B, so that clamping mechanism 9 and clamping mechanism 10 engage with receiving mechanism 50: simultaneously, tooth 51 is pressed against accessory 53 to fully secure accessory 53 within holder 1.

As shown in FIG. 5C, the result is a fully secured accessory 53 with receiving mechanism 50.

FIG. 6 is a perspective view of the alternative embodiment of the present invention mounted onto a firearm.

As illustrated, flashlight 61 has been fully secured to receiving mechanism 62 by mechanism 61. Mechanism 61 is the alternative embodiment first illustrated in FIGS. 3, 4A, 4B, 4C, and 4D, described above. By releasing lever 63*m*, mechanism 60 is both released from receiving mechanism 62, and, flashlight 61 is released from mechanism 60.

It is clear that the present invention provides a simple to use and versatile mechanism to secure a variety of apparatus to a firearm.

What is claimed is:

1. A mechanism for a firearm comprising:

a) an accessory for a firearm; and, b) a mounting mechanism having:

1) a holder configured to encircle a portion of said accessory for a firearm, 2) a clamping mechanism adapted to engage a receiving mechanism on said firearm, and, 3) a manually operated compression mechanism configured to selectively and simultaneously engage:

A) said clamping mechanism with said receiving mechanism, and

B) said holder with said accessory for a firearm, said compression mechanism having 1) at least one tooth slidably secured to said holder, said tooth further including a first engagement mechanism configured to engage one side of said receiving mechanism on said firearm, 2) a movable bracket having a second engagement mechanism configured to engage a second side of said receiving mechanism on said firearm; and, wherein said manually operated compression mechanism, when activated, compresses said receiving mechanism between said first engagement mechanism and said second engagement mechanism while inserting said at least one engaging tooth into said holder and against said accessory for a firearm, and, 3) a first guide member secured at a first end to said holder and extending through said movable bracket, the second end of said first guide being threaded to receive a first nut, and, 4) a second guide member secured at a first end to said holder and extending through said movable bracket, the second end of said second guide being threaded to receive a second nut, 4) a screw mechanism having, a) a first pin securing the first end of said first guide member to said holder and loosely engaged with said movable bracket; and, b) a second pin securing the first end of said second guide member to said holder and loosely engaged with said movable bracket.

2. The mechanism according to claim 1, wherein said manually operated compression mechanism is further configured to selectively and simultaneously disengage:

a) said clamping mechanism from said receiving mechanism; and, b) said holder from said accessory for a firearm.

3. The mechanism for a firearm according to claim 1, wherein said first guide member and said second guide member are substantially parallel.

4. The mechanism for a firearm according to claim 3, wherein said first and second nut are configured to be manually adjusted on said first and second guide members respectively.

5. The mechanism for a firearm according to claim 1, wherein said accessory for a firearm includes a sighting mechanism.

6. The mechanism for a firearm according to claim 1, wherein said accessory for a firearm includes a light.

7. A bracket for securing an accessory to a firearm comprising:

a) a holder configured to encircle a portion of said accessory;

b) a clamping mechanism adapted to engage a receiving mechanism on said firearm, and, c) a manually operated compression mechanism configured to selectively and simultaneously engage:

1) said clamping mechanism with said receiving mechanism, and 2) said holder with said accessory for a firearm, said compression mechanism having A) at least one tooth slidably secured to said holder, said tooth further including a first engagement mechanism configured to engage one side of said receiving mechanism on said firearm, B) a movable bracket having a second engagement mechanism configured to engage a second side of said receiving mechanism on said firearm; and, wherein said manually operated compression mechanism, when activated, compresses said receiving mechanism between said first engagement mechanism and said second engagement mechanism while inserting said at least one engaging tooth into said holder and against said accessory for a firearm, and, C) a first guide member secured at a first end to said holder and extending through said movable bracket, the second end of said first guide being threaded to receive a first nut, and, D) a second guide member secured at a first end to said holder and extending through said movable bracket, the second end of said second guide being threaded to receive a second nut;

3) a screw mechanism having, a) a first pin securing the first end of said first guide member to said holder and loosely engaged with said movable bracket; and, b) a second pin securing the first end of said second guide member to said holder and loosely engaged with said movable bracket.

8. The bracket according to claim 7, wherein said manually operated compression mechanism is further configured to selectively and simultaneously disengage:

a) said clamping mechanism from said receiving mechanism; and, b) said holder from said accessory for a firearm.

* * * * *